US007428786B2

(12) United States Patent
Herman et al.

(10) Patent No.: US 7,428,786 B2
(45) Date of Patent: Sep. 30, 2008

(54) METHOD AND AN APPARATUS FOR MANUFACTURING A FIBER WEB PROVIDED WITH A THREE-DIMENSIONAL SURFACE STRUCTURE

(75) Inventors: Jeffrey Herman, Bala Cynwyd, PA (US); David A. Beck, Appleton, WI (US); Thomas Thoróe Scherb, Sao Paulo (BR)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 11/449,474

(22) Filed: Jun. 8, 2006

(65) Prior Publication Data

US 2006/0225300 A1 Oct. 12, 2006

Related U.S. Application Data

(63) Continuation of application No. 10/056,489, filed on Jan. 24, 2002, now Pat. No. 7,150,110.

(51) Int. Cl.
*F26B 5/14* (2006.01)
*F26B 7/00* (2006.01)

(52) U.S. Cl. ..... 34/399; 34/306; 34/453

(58) Field of Classification Search ..... 34/115, 34/114, 306, 362, 452, 453, 454, 459, 456, 34/458, 95, 399; 162/360.3, 358.3, 117, 162/109, 111, 205, 206; 100/118, 121, 153
See application file for complete search history.

(56) References Cited

U.S. PATENT DOCUMENTS

| | | | | |
|---|---|---|---|---|
| 2,209,760 | A | 7/1940 | Berry | 100/38 |
| 5,389,205 | A | 2/1995 | Pajula et al. | 162/205 |
| 5,591,305 | A | 1/1997 | Cameron | 162/117 |
| 5,701,682 | A | 12/1997 | Chuang et al. | 34/115 |
| 6,090,241 | A | 7/2000 | Trokhan et al. | 162/109 |
| 6,103,062 | A | 8/2000 | Ampulski et al. | 162/109 |
| 6,197,154 | B1 | 3/2001 | Chen et al. | 162/109 |

FOREIGN PATENT DOCUMENTS

| | | |
|---|---|---|
| DE | 199 46 972 A1 | 4/2001 |
| GB | 2 235 705 | 3/1991 |
| GB | 2 305 156 | 4/1997 |
| WO | WO 99/47749 | 9/1999 |
| WO | WO 01/18307 | 3/2007 |

*Primary Examiner*—Kenneth B Rinehart
(74) *Attorney, Agent, or Firm*—Taylor & Aust, P.C.

(57) ABSTRACT

A method for manufacturing a fiber web having a three-dimensional surface structure and a strength. The method includes the steps of pre-imprinting the fiber web, pressing the fiber web and forming the fiber web. The pre-imprinting step pre-imprints the fiber web at a dry content of less than 25% with an imprinting band using a first pressure field. The pressing step presses the fiber web onto the imprinting band using a second pressure field. The pressing step further dewaters and dries the fiber web fixing the three-dimensional surface structure and the strength. The forming step forms the fiber web on the imprinting band.

20 Claims, 5 Drawing Sheets

METHOD AND AN APPARATUS FOR MANUFACTURING A FIBER WEB PROVIDED WITH A THREE-DIMENSIONAL SURFACE STRUCTURE

CROSS REFERENCE TO RELATED APPLICATIONS

This is a continuation of U.S. patent application Ser. No. 10/056,489, entitled "A METHOD AND AN APPARATUS FOR MANUFACTURING A FIBER WEB PROVIDED WITH A THREE-DIMENSIONAL SURFACE STRUCTURE", filed Jan. 24, 2002 now U.S. Pat. No. 7,150,110.

BACKGROUND OF THE INVENTION

1. Field of the Invention

The present invention relates to a method and to an apparatus for manufacturing a fiber web, and, more particularly to dewatering of a fiber web wherein the fiber web is a web of tissue or hygiene material, provided with a three-dimensional surface structure.

2. Description of the Related Art

The imprinting of a three-dimensional structure into the surface of a paper web, in particular into the surface of a tissue web, more particularly into the surface of hand tissue, is known (see, for example, WO 99/47749, WO 01/18307). It is further known that a very good paper quality can be achieved by so-called through-air drying (TAD). However, it is disadvantageous that the use of TAD dryers is very complex and correspondingly expensive. What is needed in the art is a method of apparatus for dewatering of a fiber web of tissue or hygiene material, having a three-dimensional surface structure, which is less complex and less expensive.

SUMMARY OF THE INVENTION

The present invention provides an improved method and an improved apparatus for manufacturing a fiber web provided with a three-dimensional surface structure with which a high quality of the end product can be achieved in an economic and correspondingly favorably priced manner even without the use of a larger TAD drying apparatus. A corresponding quality is reached with respect to the water retention capability, the water absorption rate, the bulk, etc.

The present invention provides a method for manufacturing a fiber web, in particular a web of tissue or hygiene material, with a three-dimensional surface structure, in which the fiber web is pressed, e.g. sucked, at a dry content of <25% onto an imprinting band by way of a first pressure field, and is thereby pre-imprinted, and is subsequently once more pressed onto an imprinting band by way of a further pressure field for further dewatering and drying in order to fix the three-dimensional surface structure and strength.

As a result of this embodiment, a lasting three-dimensional surface structure is produced in the relevant fiber web, i.e. in particular in the relevant paper web, tissue web, or hygiene paper web, which is also present in the desired manner in the web even after the drying process. The use of a complex and correspondingly expensive TAD process is no longer required. A lasting surface structure of, for example, a tissue web or a hygiene paper web can now also be produced downstream of the forming region or forming zone even without such a TAD drying apparatus.

An imprinting screen or an imprinting membrane is preferably used as the imprinting band (imprinting fabric) or structured band (structured fabric). The fiber web is generally pre-imprinted downstream of the forming region. In certain cases it is advantageous for the fiber web to be formed on the imprinting band used for the pre-imprinting. The fiber web can, however, also be transferred onto the imprinting band used for the pre-imprinting.

In accordance with a preferred embodiment, at least the first pressure field is produced by way of a suction element arranged on the side of the imprinting band remote from the fiber web in order to suck the fiber web into the surface structure of the imprinting band. In this embodiment, a so-called wet suction box can be used as the suction element.

It is also of advantageous for the fiber web to be pressed gently in the further pressure field, i.e. preferably over a stretch extended in the web running direction.

The further pressure field is preferably produced by way of a press nip. To effect the most gentle possible pressing of the web, this press nip can, for example, be produced between a dryer cylinder and an opposing element, with the fiber web guided through the press nip being in contact with the surface of the dryer cylinder and contacting the imprinting band with its other side. In particular a so-called Yankee cylinder can be used as the dryer cylinder. In particular a shoe press unit, which includes a flexible band guided via a press shoe in the region of the press nip, can be used as an opposing element interacting with the dryer cylinder, with a shoe pressing roll provided with a flexible roll jacket preferably being used as the shoe press unit. However, a press roll or a suction pressing roll can, for example, also be used as an opposing element interacting with the dryer cylinder.

A preferred practical embodiment of the method in accordance with the present invention is characterized in that the pre-imprinted fiber web is dried on the dryer cylinder, or the Yankee cylinder, the fiber web is creped and/or the fiber web is subsequently wound up.

In accordance with a preferred embodiment of the method in accordance with the present invention, the dry content at which the fiber web is pre-imprinted and/or the dry content at which the three-dimensional surface structure is fixed is selected in each case at <25%, in particular <15%, and preferably <10%. The water retention capability and the bulk, among other things, are thus lastingly increased, which means that the desired imprinting is also still present on the use of the end product, for example of a relevant web of tissue or hygiene material. In particular the advantage of a higher water retention capability for towel tissue (towel paper) is also still effective on the use of the relevant end product.

In accordance with a preferred practical embodiment of the method of the present invention, a suction device is used between the suction element producing the first pressure field and the press nip producing the further pressure field and the fiber web is guided together with an imprinting band both over the suction device and through the press nip. It is advantageous if the suction device has a curved surface and if the fiber web and the imprinting band are guided over this curved surface. A suction roll can, for example, be used as the suction device.

Further advantages result from the use of a press shoe due to the relatively long press nip, since a better transfer of the fiber web to the Yankee cylinder is achieved over a longer stretch.

The imprinting band can in particular be guided via the suction element or the wet suction box upstream of the suction device, i.e. for example the suction roll, in order to suck the fiber web into the three-dimensional surface structure of the imprinting band and thus to imprint this structure onto the band. At the same time, the relevant suction element results in a corresponding increase in the dry content.

It is also advantageous for the length of the press nip of the shoe press including the dryer cylinder and the shoe press unit observed in the web running direction to be selected larger than a value of approximately 80 mm and for the shoe press to be designed such that a pressure profile results over the press nip length with a maximum pressing pressure which is smaller or equal to a value of approximately 2.5 MPa. A gentle pressing is thus ensured with which it is avoided that the structure produced in the fiber web, e.g. in the tissue web or in the hygiene paper web, is again smoothed out.

As already mentioned, a suction roll, with which a pressure hood is preferably associated, can, for example, be used between the suction element producing the first pressure field and the press nip.

In accordance with a preferred practical embodiment of the method in accordance with the present invention, at least one dewatering screen with zonally different screen permeability is used in the forming region. This dewatering screen can be provided as an outer screen. This embodiment of the method is advantageous in the manufacture of towel tissue. The screen produces a fine structure which increases the water absorbing rate providing an increased water retention capability in conjunction with the imprinting in accordance with the present invention.

In certain cases, it is advantageous if a former with two circulating dewatering bands is used, which run together to form a pulp run in gap and are guided over a forming element such as a forming roll, and if a dewatering screen with zonally different screen permeability is used as an outer band not coming into contact with the forming element and/or as an inner band. In this connection, an imprinting band can be used as an inner band, for example, and preferably a dewatering screen with zonally different screen permeability as an outer band. It is, for example, also possible for the fiber web preferably to be taken over from the inner band by an imprinting band.

In wet imprinting in a tissue machine provided with an imprinting band, it is in particular a question of achieving the desired dry content. The web can be wet imprinted by way of the imprinting band using a suction box upstream of the press. To now avoid the three-dimensional surface structure, which was pre-imprinted by the wet imprinting in the region of the wet suction box, being destroyed again by a short-term high pressure in the press nip, as is the case with a conventional suction press roll or press roll, in accordance with an advantageous practical embodiment of the method in accordance with the present invention, there is guided through the press nip an imprinting band, e.g. an imprinting screen or an imprinting membrane, which is structured such that a smaller areal proportion of raised or closed zones results for this imprinting band in comparison with the areal proportion of recessed zones or holes and accordingly a smaller areal proportion of the fiber web is pressed in the press nip. The smaller areal proportion of raised or closed zones produces the web regions of high density for the strength, whereas the larger surface portion of recessed zones or holes, which remains at least substantially unpressed, provides the desired water absorption capability and the desired bulk such as has previously only been achieved by a complex and expensive TAD drying.

An imprinting band can advantageously be used in which the areal proportion of raised or closed zones is ≦40% and preferably lies in a range from approximately 20% to approximately 30%, and in particular at approximately 25%.

An imprinting band is expediently used in which the raised zones and the recessed zones result through offsets, i.e. through intersections of picks and ends, of a screen cloth. As already mentioned, an imprinting membrane can, for example, also be used in which the raised and recessed zones result through the holes. It is advantageous in this case that 100% of the surface is pressed around the holes and a higher strength results.

The relevant imprinting band can again be guided together with the fiber web, for example, over a dryer cylinder, in particular a Yankee cylinder. A shoe-pressing unit can again be used as the opposing element interacting with the dryer cylinder. The length of the press nip observed in the web running direction and the pressure profile resulting over the press nip length can also be selected as described above.

It has been found that with the method in accordance with the present invention, a water absorbing capability (g $H_2O$/g fibers) higher by 50% and a bulk ($cm^3$/g) higher by 100% can be achieved with the same tensile strength when an imprinting band is used instead of a conventional felt in the press nip before the creping. The water absorbing capability can be improved by up to 50% by creping the web and a water absorbing capability of TAD hand towel quality can be achieved by taking this circumstance into account.

The quality of the paper results from the lower pressing of the web as a consequence of the smaller areal proportion of raised zones, and not due to a TAD dryer. The permeability of the web results from the stretching of the web into the cloth structure by way of the suction element, whereby so-called pillows are produced which correspondingly increase the water absorbing capability and the bulk. A relatively complex and correspondingly expensive TAD dryer is therefore no longer necessary for this.

The function of the TAD drum and of the through-air system consists of drying the web and, for this reason, the corresponding dry content must be achieved to be able to carry out the wet imprinting in a conventional machine, i.e. in a conventional tissue machine.

To achieve the desired dry content, in accordance with a preferred embodiment of the method of the present invention, at least one felt with a foamed layer is used for dewatering the web. The foam coating can be selected such that pores in a range from approximately 3 μm to approximately 6 μm result. The corresponding capillary action is therefore utilized for dewatering. The felt is provided with a special foam layer which gives the surface very small pores whose diameters can lie in the range set forth from approximately 3μ to approximately 6 μm. The air permeability of this felt is very low. The natural capillary action is used for dewatering the web while this is in contact with the felt.

In accordance with an advantageous embodiment of the method of the present invention, a so-called spectra membrane is used for dewatering the web, with this spectra membrane preferably being used together with a conventional, in particular woven, screen. Such a spectra membrane can in particular be designed and manufactured as is described in GB 2 305 156 A in connection with its FIG. 3 and in GB 2 235 705 B.

The spectra membrane can be a membrane with a regular, non-woven mesh structure through which suction is possible. It can be provided with spun reinforcement threads which extend through the mesh structure in the web running direction (see in particular FIG. 3 of GB 2 305 156 A). This spectra membrane can in particular be a porous, reinforced membrane made from a composite, with spun threads or yarns extending in the machine direction forming the reinforcing elements and the surrounding matrix material including fluid passages, completely encapsulating the spun threads and connecting them to one another, spun thread for spun thread, to produce the non-woven spectra membrane (see in particular GB 2 235 705 B). In other respects, the spectra membrane can also be designed and manufactured as is described in GB 2 305 156 A and GB 2 235 705 B.

Since the spectra membrane has a relatively coarse mesh, it is an advantage for it to preferably be used together with a conventional, in particular woven, screen. The distribution of the through-air is thus substantially improved and the drying is thus more uniform. This function becomes necessary when the surface of the through-flow cylinder only has an open area of <25% and large areas are provided between the holes. Such a spectra membrane can be used instead of the felt with a foamed layer. An anti-rewetting effect is utilized for dewatering instead of the capillary effect.

In accordance with a further advantageous alternative embodiment of the method of the present invention a so-called anti-rewetting membrane or anti-rewetting fabric (or anti-rewet fabric) can also be used for dewatering the web. The anti-rewetting membrane can in particular include the following:

at least one air distribution fabric layer, with such an air distribution fabric layer being configured for a coming into contact with the fiber web; and a perforated film layer, which can consist of a polyester film or of a plastic film, wherein the perforated film layer has a first film side and a second film side and wherein the first film side can be laminated or applied to the relevant air distribution fabric layer. The perforated film layer can also be brought into direct contact with the paper web, while in this case, however, the positive effect being substantially lower. A respective air distribution fabric layer can include a plain weave (linen bond) or a fabric of a plurality of floating threads (multi-float weave, multi-strand bond; weave type). A respective air distribution fabric layer can include a fabric consisting of a plurality of floating threads (multi-float weave). The perforated film layer can include a series of perforation holes, with each set of perforation holes, which are spaced apart as closely as possibly, being separated from the others by a perforation space, with each air distribution fabric layer having an associated kind of material bond or weave and with the kind of material bond or weave having an interval distance of the bond kind or weave kind which is equal to or larger than the perforation space. The bond kind or weave kind interval distance can in particular also be larger than the perforation space. The perforation film layer can have a series of perforation holes, with the perforation film layer being able to have, for example, approximately 40,000 holes per $m^2$. The perforation film layer can in particular have a series of perforation holes, with the perforation film layer being able to have, for example, less than approximately 200,000 holes per $m^2$. The perforation film layer can have an open area, for example, in the range from approximately 1% to approximately 30% and preferably in a range from, for example, approximately 5% to approximately 15%. The perforated film layer can, for example, have a thickness of less than approximately 0.04 inches, with the thickness, for example, being less than approximately 0.005 inches. Moreover, the anti-rewetting membrane can, for example, include a first air distribution fabric layer and a second air distribution fabric layer, with the first air distribution fabric layer being able to be laminated or applied to the first film side and with the second air distribution fabric layer being able to be laminated or applied to the second film side. A respective air distribution material layer can, for example, be manufactured of satin material.

The anti-rewetting membrane can be used together with a conventional, in particular woven, screen or also without an additional screen or the like.

The method in accordance with the present invention thus also provides the advantage that substantially higher dry contents of the tissue web are achieved even upstream of the dryer cylinder, in particular the Yankee cylinder, by avoiding the rewetting as a consequence of the embodiment of the method in accordance with the present invention and indeed with the high specific bulk which is important for tissue. It is of particular advantage if the web is wet imprinted at a low dry content upstream of a dewatering unit or dewatering apparatus.

A pressure difference of the compressed gas between the two sides of the web is absolutely necessary for the wet imprinting. The use of a suction box is particularly advantageous.

As already mentioned, the anti-rewetting membrane does not necessarily have to be used together with a conventional, in particular woven, screen, since such an anti-rewetting membrane also effects a good distribution of the through-medium.

A clothing, e.g. a screen, felt with a foamed layer, a spectra membrane—preferably together with a conventional, in particular woven, screen—or an anti-rewetting membrane with or without a conventional, in particular woven, screen, can be guided together with an imprinting band and a fiber web interposed therebetween around a suction roll, with the clothing preferably being in contact with the suction roll.

The clothing with a foamed layer, spectra membrane, preferably together with a conventional, in particular woven, screen or an anti-rewetting membrane with or without a conventional, in particular woven, screen, can, for example, wrap a suction roll with a diameter from, for example, approximately 2 m to 3 m, or a plurality of suction rolls with smaller diameters, preferably two suction rolls each with a diameter of, for example, approximately 2 m. The dwell time of the web in the region of the suction roll or suction rolls should be larger than approximately 0.15 s and less than approximately 0.40 s.

The relevant suction roll can have, for example, a vacuum applied to its lower side or a suction roll with an associated siphon extractor can be used. In particular with a lower diameter, the water can, for example, also be spun into a channel by centrifugal force. The water can in particular also be blown off by way of an air knife.

Dewatering while utilizing the capillary effect is already described in U.S. Pat. No. 5,701,682, but the relevant capillary element is here a part of the suction roll, which is disadvantageous for the conditioning of the capillary element.

Despite the utilization of the capillary effect or of the anti-rewetting effect for the dewatering, the suction device can in particular have a hood standing under overpressure associated with it to support the underpressure effect of the suction device and to be able to work at higher temperatures (e.g. ~140° C.).

In accordance with a further preferred embodiment of the method in accordance with the present invention, to drive out water by way of gas pressure, the fiber web is guided together with an imprinting band at least once, preferably twice, through a pressure space which is bounded by at least four rolls arranged in parallel into which compressed gas is fed. In this connection, the fiber web is preferably guided together with the imprinting band between membranes through the pressure space, with preferably an air distribution membrane and an anti-rewetting membrane being used. The basic principle of such a displacement press in which the water in the fiber web is displaced by air, is described, for example, in DE 19946972.

A method in accordance with the present invention for dewatering a fiber web, in particular a web of tissue or hygiene material, is characterized in that to drive out water by way of gas pressure, the fiber web is guided together with an imprinting band at least once, and preferably twice, through a pressure space which is bounded by at least four rolls arranged in parallel and into which a compressed gas is fed, and in that the fiber web is guided together with the imprinting band between membranes through the pressure space, with preferably an air distribution membrane and an anti-rewetting membrane being used.

An apparatus in accordance with the present invention for manufacturing a fiber web, in particular a web of tissue or hygiene material, provided with a three-dimensional surface structure is characterized in that the fiber web is pressed at a dry content of <25% onto an imprinting band, e.g. by suction, by way of a first printing field and is thereby pre-imprinted, and is subsequently once more pressed onto an imprinting band by way of a further pressure field for further dewatering and drying in order to fix the three-dimensional surface structure and strength.

An apparatus in accordance with the present invention for dewatering a fiber web, in particular a web of tissue or hygiene material, is characterized in that, to drive out water by way of gas pressure, the fiber web is guided together with an imprinting band at least once, and preferably twice, through a pressure space which is bounded by at least four rolls arranged in parallel and into which a compressed gas can be led, and in that the fiber web is guided together with the imprinting band and between membranes through the pressure space, with preferably an air distribution membrane and an anti-rewetting membrane being used.

The present invention can be used in particular with crescent formers, duo formers, C wrap formers, S wrap formers and in the manufacture of multi-layer and multi-ply tissue.

An advantage of the present invention is a three-dimensional surface structure in the relevant fiber web is present in the web even after the drying process.

Another advantage is the use of a complex and correspondingly expensive TAD process is no longer required.

Yet another advantage is a lasting surface structure can also be produced downstream of the forming region or forming zone even without such a TAD drying apparatus.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
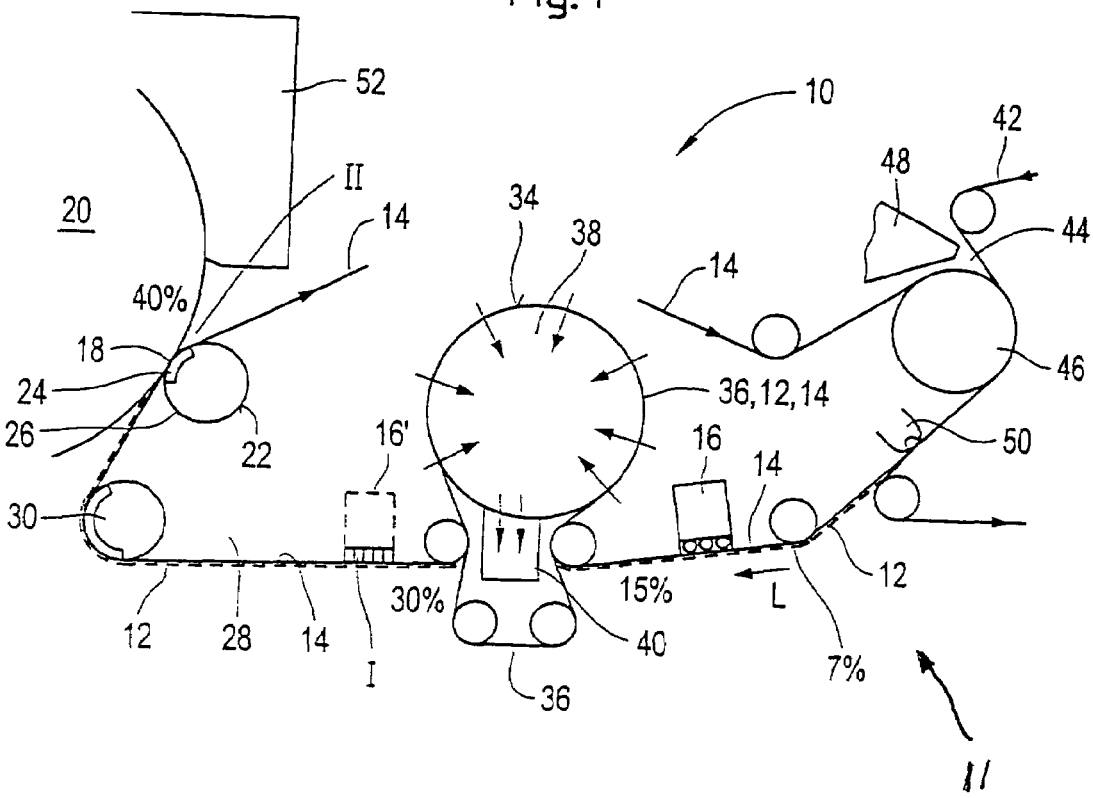
FIG. 1 is a partially schematic side view of an embodiment of the present invention for manufacturing a fiber web with a three-dimensional surface structure in which a dewatering apparatus includes the capillary action of a felt with a foamed layer, the action of a spectra membrane, or the action of a rewetting membrane for dewatering.

Referring now to the drawings, and more particularly to FIG. 1, there is shown an embodiment of apparatus 10 of the present invention for manufacturing fiber web 12 provided with a three-dimensional surface structure in which dewatering apparatus 34 is provided in which, for example, the capillary action of a felt with a foamed layer, jointly designated as 36, is utilized for dewatering. In this connection, the foam layer can in particular be selected such that pores result in a range from approximately 3 μm to approximately 6 μm. Apparatus 10 generally includes former 11 with a forming region.

Instead of felt 36 with foamed layer, alternatively felt with foamed layer 36 can be a spectra membrane and can, for example, also be used, with spectra membrane preferably being used together with a conventional, in particular woven, screen. Alternatively, felt with foamed layer 36 can be a so-called anti-rewetting membrane or clothing can also be used. Clothing 36 can be a felt with foamed layer, a spectra membrane or a screen. Anti-rewetting membrane can be used together with a conventional, in particular woven, screen or also without such an additional screen or the like.

Felt 36 with foamed layer is guided together with imprinting band 14 with a surface structure and fiber web 12 interposed therebetween about a large suction roll 38, with felt 36 preferably being in contact with suction roll 38. Suction roll 38 wrapped, for example, by felt 36 with foamed layer can, for example, have a diameter from approximately 2 m to approximately 3 m. Suction roll 38 can have vacuum 40 applied to its lower side, alternatively vacuum 40 can be a siphon extractor or an air knife, either associated with suction roll 38.

In the forming region, at least one dewatering screen 54 (FIG. 2) with zonally different screen permeability can be provided.

A former 11 with two peripheral dewatering bands, imprinting band 14 and dewatering band 42, is provided, with imprinting band 14 simultaneously serving as the inner band. The two dewatering bands 14, 42 run together while forming a pulp run-in gap and are guided over forming element 46 such as in particular a forming roll.

Imprinting band 14 is formed by the inner band of former 11 which comes into contact with forming element 46. Dewatering band 42 which is the outer band does not come into contact with forming element 46, can in particular be provided as a dewatering screen with zonally different screen permeability.

The fiber suspension is introduced into the pulp run-in gap 44 by way of a head box 48. Pick-up element 50, which alternatively can be a separation element, is provided downstream of forming element 46 and fiber web 12 is held on imprinting band 14 by this during the separation from dewatering band 42. Suction element 16 (solid representation) is preferably provided upstream of dewatering apparatus 34 with capillary action or, for example, with the action of spectra membrane 36 or anti-rewetting membrane 36 with or without an additional conventional screen and fiber web 12 is pressed onto imprinting band 14 by this. Alternatively (broken line representation of suction element 16 in FIG. 1), suction element 16 can, however, also be arranged between dewatering apparatus 34 with, for example, capillary action, etc. and suction device 30, which alternatively can be a suction roll.

Fiber web 12 and imprinting band 14 are guided through press nip 18 formed between dryer cylinder 20 and shoe press unit 22 which can alternatively be an opposing element. Shoe press unit 22 includes flexible band 26, which alternatively can be a flexible roll jacket, guided over press shoe 24 in the region of press nip 18. Imprinting band 14 and fiber web 12 are guided upstream of press nip 18 about suction device 30 which can in particular be a suction roll. Dryer cylinder 20 can in particular be a Yankee cylinder. In this connection, dryer hood 52 can be associated with dryer cylinder 20.

The dry content of fiber web 12 upstream of dewatering apparatus 34 amounts to approximately 10% to approximately 25%; in the region downstream of dewatering apparatus 34, for example approximately 30% to approximately 40%.

Fiber web 12 is therefore in particular pressed, e.g. sucked, at a dry content of <25%, in particular <15% and preferably <10%, onto imprinting band 14 or structured band by way of first pressure field I in the region of suction element 16 or 16 and is thereby pre-imprinted, in particular, and is subsequently once more pressed onto imprinting band 14 by way of second pressure field II in the region of press nip 18 for further dewatering and drying in order to fix the three-dimensional structure and strength. In this connection, in particular an imprinting screen can be provided as imprinting band 14.

Figure 1A:
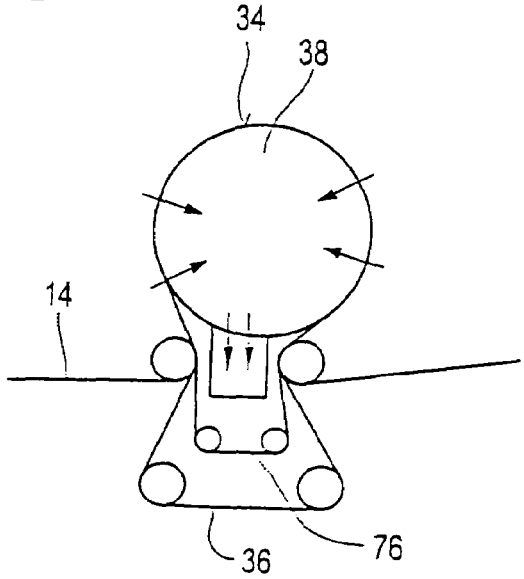
FIG. 1A is a partially schematic side view of the dewatering apparatus of an embodiment of the present invention with a spectra membrane or a rewetting membrane, optionally with an additional conventional screen.

FIG. 1A shows a schematic representation of dewatering apparatus 34 with spectra membrane 36 which is used in the present example together with a conventional, in particular woven, screen 76. In this FIG. 1A, a vacuum producing apparatus such as in particular through-air cylinder or alternatively large suction roll 38 and the imprinting band or imprinting screen 14 can also again be recognized.

Figure 2:
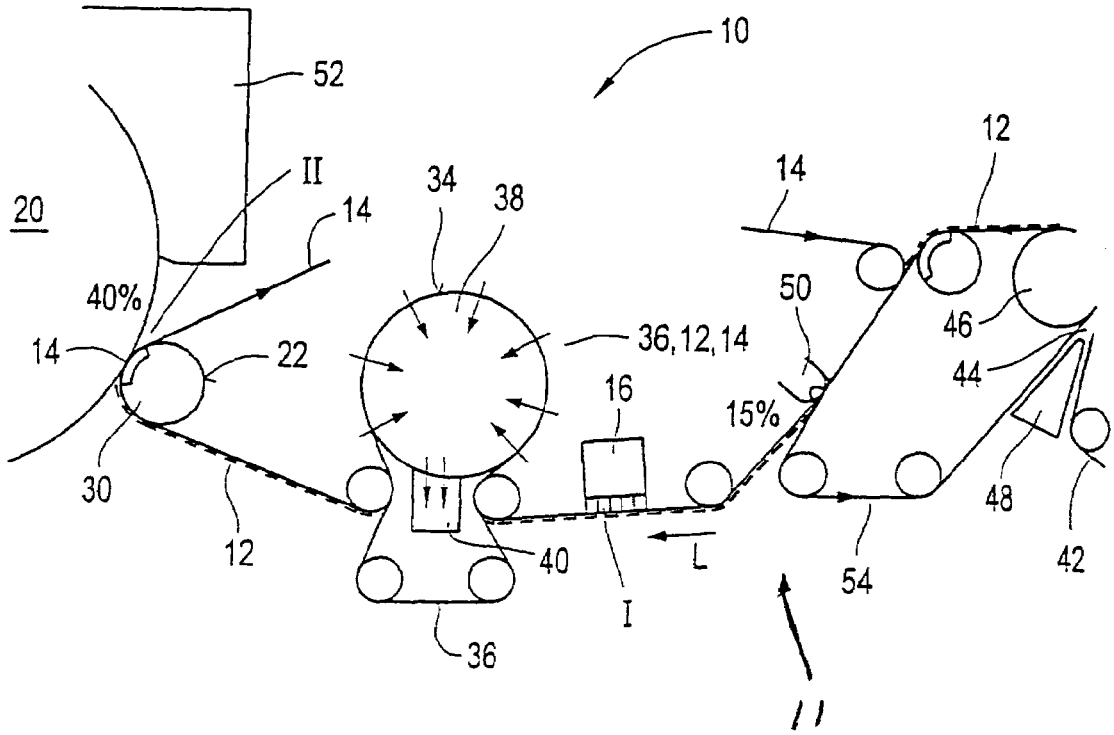
FIG. 2 is a partially schematic side view of another embodiment of the present invention.

The embodiment shown in FIG. 2 initially differs from the embodiment of FIG. 1 in that fiber web 12 is taken over by imprinting band 14 from dewatering screen 54, an inner band of the former. Inner band 54 or outer band 42 of the former can again be provided as a dewatering screen with zonally different screen permeability. The two peripheral dewatering bands 42, 54 again run together while forming a pulp run-in gap 44, with them again being guided via forming element 46 such as in particular a forming roll. The pulp run-in gap 44 is again charged with fiber suspension by way of head box 48. In contrast to the embodiment in accordance with FIG. 1, the fiber suspension is, however, supplied from below in the embodiment shown in FIG. 2.

Pick-up element 50, which can alternatively be a separation element, is provided within the loop of imprinting band 14 and fiber web 12 is held on imprinting band 14 by this on the separation from inner band 54 of the former.

Suction element 16 provided within the loop of imprinting band 14 is arranged upstream of dewatering apparatus 34 with a capillary action or, for example, of the action of a spectra membrane or of an anti-rewetting membrane with or without an additional, conventional screen, with generally, however, an arrangement downstream of apparatus 34 also being possible.

The dry content of the fiber web in the present example amounts to between approximately 10% and 25% in the region of pick-up element 50, between approximately 15% and 30% in the region upstream of dewatering apparatus 34 and between approximately 35% and 45% in the region downstream of this apparatus 34. In this case, a pressing roll 28 can be provided instead of a shoe press unit.

The deflection roll provided adjacent to the dewatering apparatus 34 can also be a suction roll for a better web transfer.

Figure 2A:
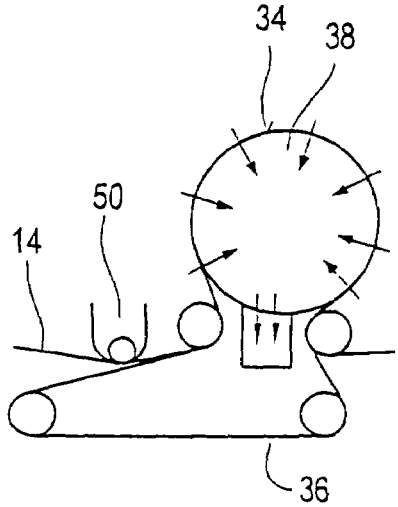
FIG. 2A is a partially schematic side view of another embodiment of the present invention including a pick-up or separation element for a better web transfer.

Another variant with a pick-up element 50 or a separation element for a better web transfer is shown in FIG. 2A.

In another respect, this embodiment can have at least substantially the same design as that in accordance with FIG. 1. Elements corresponding to one another are assigned the same reference numerals.

Figure 3:
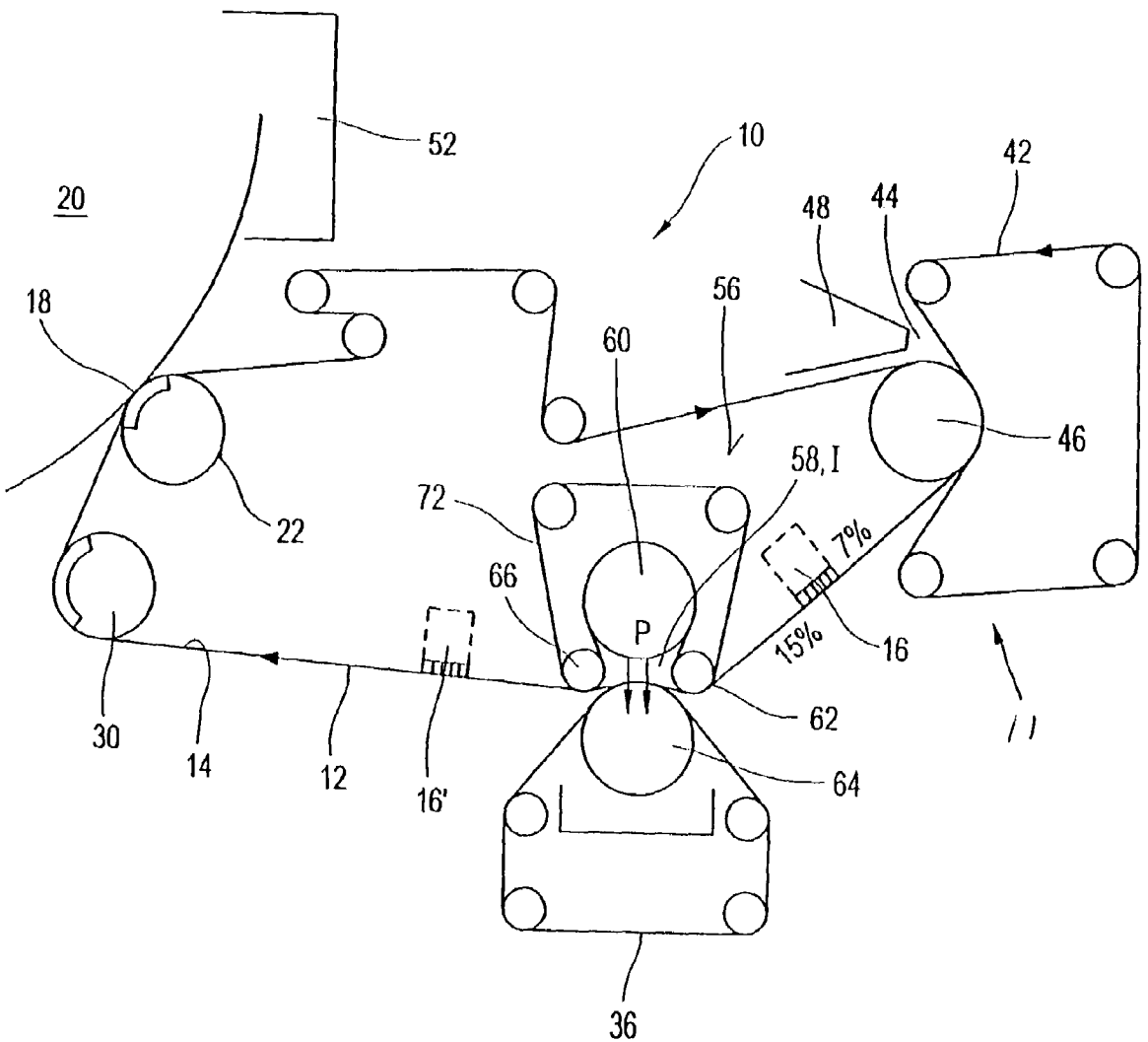
FIG. 3 is a partially schematic side view of another embodiment of the present invention in which a displacement press is additionally provided.

FIG. 3 shows in a partially schematic representation an embodiment of apparatus 10 in which displacement press 56 is provided. In this connection, to drive out water by means of gas pressure, fiber web 12 is guided together with imprinting band 14 at least once through pressure space 58 which is bounded by at least four rolls 60-66 arranged in parallel and into which compressed gas can be led. In this connection, fiber web 12 is preferably guided through pressure space 58 together with imprinting band 14 and membrane 72 as well as, for example, a spectra membrane 36 or an anti-rewetting membrane 36. Membrane 72 can be an air distribution membrane.

In the present case, imprinting band 14 forms the inner band of the former which in turn includes forming element 46 such as a forming roll in whose region the inner band provided as imprinting band 14 and outer band 42 run together while forming a pulp run-in gap 44 which is charged with fiber suspension by way of head box 48.

Subsequent to air press 56, fiber web 12 is guided with imprinting band 14 over suction device 30, in particular a suction roll, and through press nip 18 formed between dryer cylinder 20, in particular a Yankee cylinder, and shoe press unit 22. In the example shown, dryer hood 52 is again associated with dryer cylinder or Yankee cylinder 20.

In the present case first pressure field I, through which fiber web 12 is pressed onto imprinting belt 14 and correspondingly pre-imprinted at a dry content of <25%, in particular <15%, and preferably <10%, can be produced by suction element 16.

Figure 4:
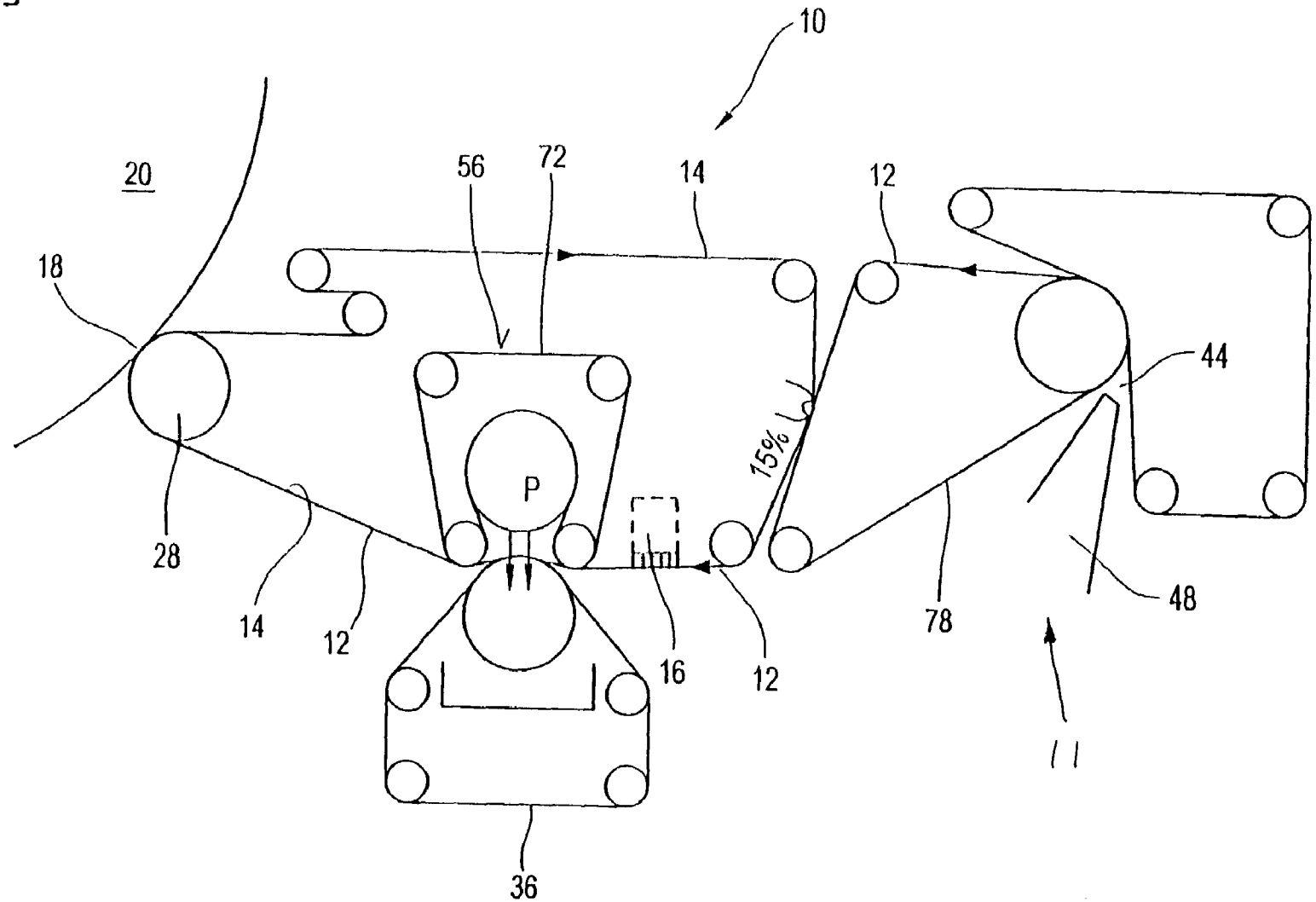
FIG. 4 is a partially schematic side view of another embodiment of the present invention including a displacement press.

FIG. 4 shows in a partially schematic side view of a further embodiment with a displacement or air press 56 with which pressing pressures can be produced as with dewatering apparatus 34, in particular, however, also substantially higher pressures from, for example, up to 2, 3 or 10 bar depending on the paper type. The embodiment of FIG. 4 initially differs from that in accordance with FIG. 3 in that inner band 78 of the former is provided separately from imprinting band 14 and fiber web 12 is transferred to imprinting band 14 from inner band 78. Moreover, the fiber suspension is poured into pulp run-in gap 44 diagonally from the bottom to the top by way of head box 48.

Furthermore, in the present example, suction device 30 provided in the embodiment in accordance with FIG. 3 is omitted. Instead of shoe press unit 22, a conventional pressing roll 28 is provided, for example, which forms press nip 18 with dryer cylinder 20, in particular a Yankee cylinder.

Membrane 72 can, for example, be a fine membrane and membrane 36 can, for example, be a coarse-mesh spectra membrane or an anti-rewetting membrane.

In another respect, this embodiment shown in FIG. 4 can again have at least substantially the same design as that in FIG. 3.

Figure 5:
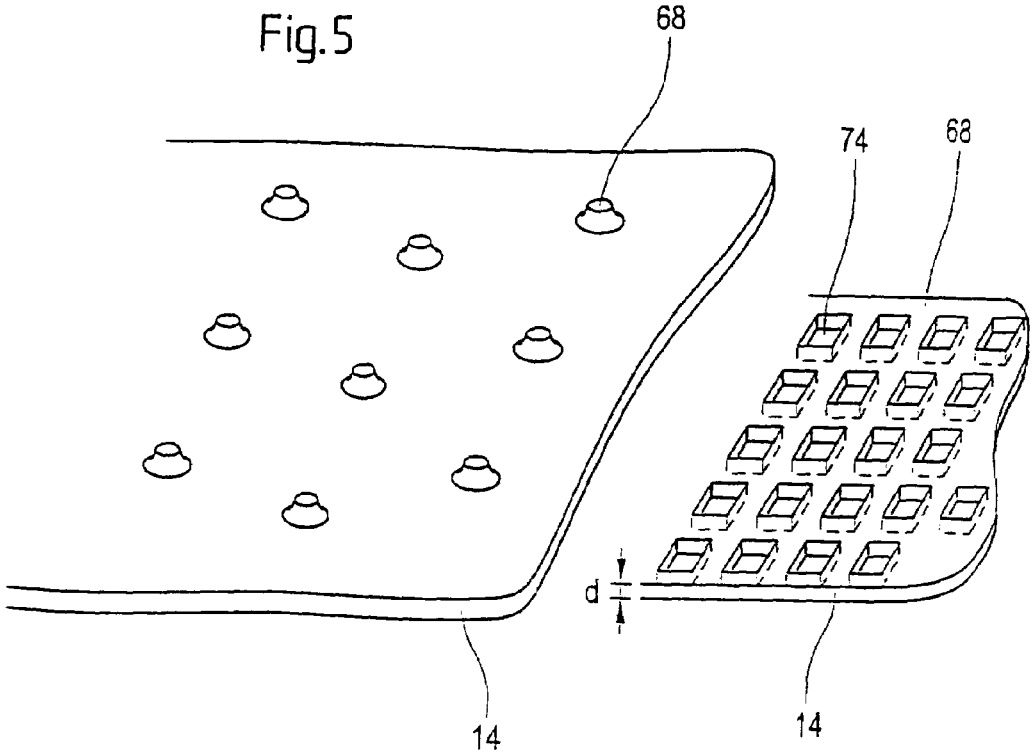
FIG. 5 is a perspective view of an embodiment of an imprinting band with a smaller areal proportion of raised zones in comparison with the areal proportion of recessed zones.
Figure 6:
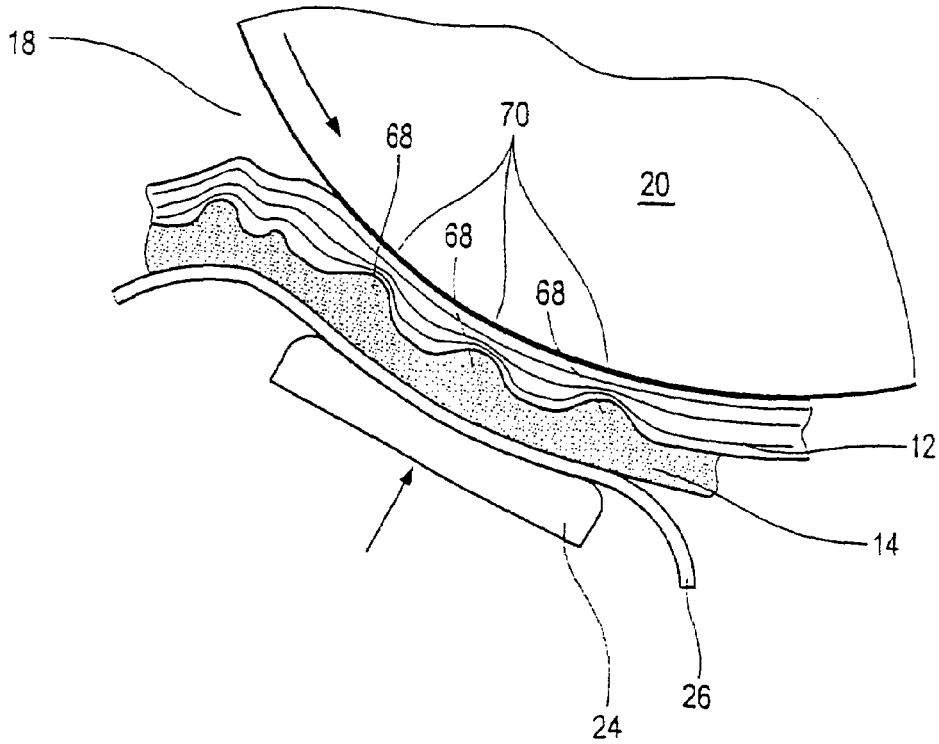
FIG. 6 is a partially schematic section view of an embodiment of a press nip through which the imprinting band shown in FIG. 5 is led together with the fiber web.

As can be recognized, for example, with reference to FIGS. 5 and 6, the respective imprinting band 14, e.g. imprinting screen (see in particular the left part of FIG. 5) or imprinting membrane (see in particular the right part of FIG. 5), guided through press nip 18 can be structured such that for this imprinting band 14 a smaller areal proportion of raised or closed zones 68 results in comparison with the areal proportion of recessed zones or holes 74 and accordingly a smaller areal proportion of fiber web 12 is pressed in press nip 18.

In this connection, the areal proportion of raised or closed zones 68 can in particular be <40% and can preferably lie in a range of between approximately 20% and 30% and in particular at approximately 25%.

Raised zones 78 and the recessed zones can result, for example, due to offsets, i.e. due to intersection points of picks and ends, of a screen fabric. In the case of the pressing membrane reproduced in the right hand part of FIG. 5, a corresponding structure arises due to holes 74.

FIG. 5 shows a perspective view of a corresponding imprinting band 14, e.g. imprinting felt or imprinting membrane, with a smaller areal proportion of raised or closed zones 68 in comparison with an areal proportion of recessed zones or holes 74.

The thickness d of imprinting membrane 14 shown in the right part of FIG. 5 can be, for example, between approximately 1 mm and 3 mm. The open area can in particular be larger than 50% and preferably larger than 60% and more preferably lie in a region between approximately 70% and 75%. The open area is the percentage of combined hole area versus total imprinting band 14 area. The membrane preferably consists of a material resistant to the fiber chemistry. It can consist, for example, of polyurethane.

FIG. 6 shows a partially schematic section view through press nip 18 through which imprinting band 14 shown in FIG. 5 is guided together with fiber web 12. In this connection, imprinting band 14 is in contact with flexible band 26 of the shoe press unit which is guided in the region of press nip 18 over press shoe 24 via which the desired pressing force can be applied. Fiber web 12 contacts dryer cylinder 20, preferably a Yankee cylinder. Moreover, in FIG. 6, pressing zones 70 resulting as a consequence of raised zones 68 can be recognized.

Fiber web 12 is already imprinted upstream of the nip. As can be recognized with reference to FIG. 6, it already contacts the imprinting band upstream of the nip.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A method for manufacturing a fiber web having a three-dimensional surface structure and a strength, comprising the steps of:

introducing a fiber suspension from a headbox onto an imprinting band, said fiber suspension becoming the fiber web;

pre-imprinting the fiber web at a dry content of less than 25% with said imprinting band using a first pressure field;

pressing the fiber web onto said imprinting band using a second pressure field, said pressing step further dewatering and drying the fiber web fixing the three-dimensional surface structure and the strength; and forming the fiber web on said imprinting band, said introducing step, said pre-imprinting step, said pressing step and said forming step each involving said imprinting band without transfer of the fiber web therefrom.

2. The method of claim 1, wherein said method is carried out using an imprinting screen as said imprinting band.

3. The method of claim 1, wherein said method is carried out using an imprinting membrane as said imprinting band.

4. The method of claim 1, wherein said pre-imprinting step occurs subsequent to a forming region relative to a running direction.

5. The method of claim 1, wherein said pre-imprinting step further includes transferring the fiber web onto said imprinting band.

6. The method of claim 1, wherein said method is carried out using said imprinting band for said pre-imprinting step and for said fixing in said pressing step.

7. The method of claim 1, wherein at least one of said pre-imprinting step and said pressing step produce at least one of said first pressure field and said second pressure field using at least one suction element, said at least one suction element located at a side of said imprinting band opposite the fiber web, said at least one suction element motivating the fiber web into an imprinting band surface structure.

8. A method for manufacturing a fiber web having a three-dimensional surface structure and a strength, comprising the steps of:

introducing a fiber suspension from a headbox onto an imprinting band, said fiber suspension becoming the fiber web;

pre-imprinting the fiber web at a dry content of less than 10% with said imprinting band using a first pressure field;

pressing the fiber web onto said imprinting band using a second pressure field, said pressing step further dewatering and drying the fiber web fixing the three-dimensional surface structure and the strength;

guiding a clothing together with said imprinting band, with the fiber web interposed therebetween about at least one suction roll; and forming the fiber web on said imprinting band, said introducing step, said pre-imprinting step, said pressing step, said guiding step and said forming step each involving said imprinting band without transfer of the fiber web therefrom.

9. The method of claim 8, wherein said method is carried out using one of an imprinting screen and an imprinting membrane as said imprinting band.

10. The method of claim 9, wherein said pre-imprinting step occurs subsequent to a forming region relative to a running direction.

11. The method of claim 10, wherein said pre-imprinting step further includes transferring the fiber web onto said imprinting band.

12. The method of claim 10, wherein said method is carried out using said imprinting band for said pre-imprinting step and for said fixing in said pressing step.

13. The method of claim 12, wherein at least one of said pre-imprinting step and said pressing step produce at least one of said first pressure field and said second pressure field using at least one suction element, said at least one suction element located at a side of said imprinting band opposite the fiber web, said at least one suction element motivating the fiber web into an imprinting band surface structure.

14. A method for manufacturing a fiber web having a three-dimensional surface structure and a strength, comprising the steps of:

introducing a fiber suspension from a headbox onto an imprinting band, said fiber suspension becoming the fiber web;

pre-imprinting the fiber web at a dry content of less than 25% with said imprinting band using a first pressure field;

pressing the fiber web onto said imprinting band using a second pressure field, said pressing step further dewatering and drying the fiber web fixing the three-dimensional surface structure and the strength, said method being carried out using a plurality of rolls arranged in parallel bounding a pressure space pressurized by a compressed gas for driving out water from the fiber web, the fiber web and said imprinting band guided together through said pressure space at least once;

positioning the fiber web and said imprinting band between a fine membrane and a coarse-mesh membrane prior to said pressing step; and forming the fiber web on said imprinting band, said introducing step, said pre-imprinting step, said pressing step, said positioning step and said forming step each involving said imprinting band without transfer of the fiber web therefrom.

15. The method of claim 14, wherein said method is carried out using one of an imprinting screen and an imprinting membrane as said imprinting band.

16. The method of claim 15, wherein said pre-imprinting step occurs subsequent to a forming region relative to a running direction.

17. The method of claim 16, wherein said pre-imprinting step further includes transferring the fiber web onto said imprinting band.

18. A method for manufacturing a fiber web having a three-dimensional surface structure and a strength, comprising the steps of:

introducing a fiber suspension from a headbox onto an imprinting band, said fiber suspension becoming the fiber web;

pre-imprinting the fiber web at a dry content of less than 25% with said imprinting band using a first pressure field;

pressing the fiber web onto said imprinting band using a second pressure field, said pressing step further dewatering and drying the fiber web fixing the three-dimensional surface structure and the strength, said pressing step including the steps of:

bounding a pressure space with at least four rolls;

pressurizing said pressure space with a compressed gas;

interposing the fiber web between a plurality of membranes; and guiding the fiber web, said plurality of membranes and an imprinting band through said pressure space at least once;

positioning the fiber web and said imprinting band between a fine membrane and a coarse-mesh membrane prior to said pressing step; and forming the fiber web on said imprinting band, said introducing step, said pre-imprinting step, said pressing step, said positioning step and said forming step each involving said imprinting band without transfer of the fiber web therefrom.

19. The method of claim 18, wherein said method is carried out using one of an imprinting screen and an imprinting membrane as said imprinting band.

20. The method of claim 19, wherein said pre-imprinting step occurs subsequent to a forming region relative to a running direction.

* * * * *